US005305705A

United States Patent [19]

Gagliano

[11] Patent Number: 5,305,705

[45] Date of Patent: Apr. 26, 1994

[54] COLLAPSIBLE ROAD MARKER AND METHOD

[76] Inventor: Greg R. Gagliano, 221 Primrose Cir., Chesterton, Ind. 46304

[21] Appl. No.: 837,349

[22] Filed: Feb. 14, 1992

[51] Int. Cl.[5] ..... E01F 09/00

[52] U.S. Cl. ..... 116/63 P; 040/610; 359/551

[58] Field of Search ..... 116/63 P, 63 C; 40/610, 40/612; 359/551, 552, 528, 529; 404/9, 11

[56] References Cited

U.S. PATENT DOCUMENTS

| | | | |
|---|---|---|---|
| 2,762,328 | 9/1956 | Weig | 40/612 X |
| 3,132,624 | 5/1964 | Shoemaker, Jr. | 116/63 C |
| 3,496,904 | 2/1970 | Rimkus | 116/63 C |
| 3,520,235 | 7/1970 | Palazzolo et al. . | |
| 3,521,596 | 7/1990 | Schlein | 116/63 C |
| 3,707,320 | 12/1972 | Brynes | 116/63 C X |
| 4,006,702 | 2/1977 | St. Cyr | 116/63 P |
| 4,197,807 | 4/1980 | Campbell . | |
| 4,256,050 | 3/1981 | Barnard . | |
| 4,759,606 | 7/1988 | McDowell | 404/9 X |

*Primary Examiner*—Daniel M. Yasich

*Attorney, Agent, or Firm*—Potthast & Ring

[57] ABSTRACT

A traffic marker body defined by a conical spiral arm (16) mounted for collapse into a flat core held in matching recess (22) in a base (12) by means of an automatic locking mechanism including a latch member (24) with friction reducing rollers (34, 36) to facilitate lateral travel along cam guide surfaces (38, 40, 48, 50) into alignment with a latch engaging member including a slot (46) to lock the traffic marker body (14) into a collapsed condition (FIG. 1). The adjacent segments of the spiral arms (16) are spaced sufficiently for air passageways passing through the body (14) for improved stability and to enhance visibility of elongate reflector members (54) woven in and out between adjacent segments of a spiral arm (16) with reflective surfaces on both sides for creation of visual depth and a twinkling effect for enhanced visibility.

25 Claims, 2 Drawing Sheets

COLLAPSIBLE ROAD MARKER AND METHOD

BACKGROUND OF THE INVENTION

1. Field of the Invention

This invention generally relates to temporary, portable road markers and, more particularly, to collapsible road markers and apparatus and methods for releasibly locking them in a collapsed state, for mounting reflector members to enhance visibility and for enhancing resistance against wind forces.

2. Description of the related art including information disclosed under 37 CFR 1.97–1.99

Collapsible road markers are known which enable a conical road marker body to be collapsed into a base for storage and transport.

In U.S Pat. No. 3,520,235 issued Jul. 14, 1970 to Palazzolo et al. a collapsible road marker is formed of tepee-like structure with a flexible conical sheet of plastic or other flexible sheet material which is supported in an erect position by means of a two piece center support pole which disassembles for storage in a base. This design is intended for personal use to warn traffic away from an automobile during an emergency road side repair, or the like. However, it is not well suited for use as a temporary marker for exterior local repairs where thousands of markers need to be moved on a regular basis and which are used continuously under the most harsh wind conditions. The central support pole disables the marker from being quickly collapsed or erected which is necessary when dealing with thousands of units, while the solid plastic or other outer body presents a large horizontal surface area making the marker susceptible to tipping due to wind forces and which is insufficiently durable for long continuous wear.

Subsequent designs are shown in U.S. Pat. Nos. 4,197,807 issued Apr. 15, 1980, to Campbell and 4,256,050 issued Mar. 17, 1981, to Barnard which employ a spiral body that collapses into a flat coil which is contained in a generally planar base when not in use. While these collapsible coils are better suited for regular traffic control applications, they still suffer from some of the same problems as the marker of Palazzolo et al. The spiral body of Barnard is closed throughout the length of its body making it highly vulnerable to wind forces. While the marker of Campbell is somewhat improved, since incidentally to the design, some air passageways are provided adjacent the base. However, the portions of the marker adjacent its top at which the moment arm for tipping forces is greatest, have no wind passageways passing straight through the body as needed for optimum stability in high wind.

Another problem with these known spiral arms collapsible is the lack of any means for easily and quickly locking the collapsible body in the collapsed position, so it does not undesirably deploy into an erect position during transportation, handling or storage. In the road marker of Barnard, the spiral arms are not resiliently biased toward the erect conical shape, and no separate locking mechanism is provided to prevent inadvertent deployment. A locking mechanism is provided in the marker of Campbell to hold the resilient spiral body in a flat coil configuration, but it employs an awkward wing nut which must be manually passed entirely through a slot while the coil is held in the collapsed condition and then manually forced to a locked position. Likewise, when unlocking the spiral body, the wing nut must be manually aligned to an unlocking position.

Another disadvantage of these collapsible road markers is the failure to provide a single means to releasibly attach reflective members to enhance night time visibility. In the marker of Palazzolo et al., the plastic cover is brightly colored and luminous, and no means are provided for the addition of additional reflective members. In each of the markers of Barnard and Campbell, reflective strips are attached along the lengths of the arms only, so that only horizontal reflective pattern are created. The reflective surfaces only face outwardly and thus substantial amounts of reflective material is required to achieve the desired visibility. However, there is no means for mounting additional reflector members. In addition, the reflective surfaces only face outwardly or are otherwise blocked from viewing from the inside or opposite side of the collapsible body.

SUMMARY OF THE INVENTION

It is therefore the principal object of the invention to provide a collapsible road marker and methods for using same which overcomes the disadvantages of the known collapsible road markers noted above by providing a collapsible road marker with a self actuating locking mechanism, a body with improved wind resistance against toppling means for the easy addition and removal of reflective members and with interior reflectivity for improved visibility.

This object is achieved in part by provision of a collapsible road marker having a base, a collapsible body with a fixed end mounted adjacent to the base and a distal end mounted for movement in a direction between the base, whereat the distal end is located when in a collapsed position, and an erect position spaced from the base with an automatic locking assembly for selectively holding the movably mounted distal end of the collapsible body adjacent to the base which facilitates quick locking and unlocking of the collapsible body. This automatic locking assembly includes a latch member mounted to the one of the collapsible body and the base for movement between a locked position and a nonlocked position, a latch engaging member mounted to the other of the collapsible body and the base to interlock with the latch member when in a locked position and means for automatically moving the latch member at least partially to the locked position to interlock with the latch engaging member in response to relative movement of the latch member and the latch engaging member toward each other and into adjacent interrelationship.

The object of facilitating quick locking and unlocking of the collapsible body is also achieved in part through provision of a collapsible road marker, comprising a resilient spiral arm defining a collapsible body having a generally conical shape with a central axis of symmetry passing through the apex, a latch member mounted to the collapsible body at the apex and a base member with a slot for receiving the latch member to block it and the apex against movement about said central axis, said slot frictionally holding the latch member against removal from blocking engagement within the slot by opposing forces of the resilient spiral arm.

The objective of reducing susceptibility to wind forces is achieved through provision of a collapsible road marker with a hollow collapsible body having a central axis within an outer wall having a plurality of passages and means for moving the collapsible body along the central axis to an erect position in which the plurality of passages on opposite parts of the outer wall are aligned to define substantially straight air passageways passing through the entire collapsible body between the opposite parts of the outer wall. These passageways extend in a direction substantially transverse to the central axis, and the passageways are defined substantially over the entire collapsible body including the positions farthest from the base.

The objective of improved visibility is achieved through provision of a collapsible road marker having a base, a hollow, collapsible body defined by a wall surrounding a central axis with a fixed end mounted adjacent the base and a distal end mounted for movement in a direction between the base, whereat the distal end is located when in a collapsed position, and an erect position spaced from the base with an improved reflector assembly. The reflector assembly includes means for providing a plurality of passageways through the outer wall of the collapsible body between the distal end and the base and at least one elongate, flexible reflector member woven in and out through at least some of said plurality of passageways.

The objective of improved locking is achieved by provision of a method of locking a collapsible road marker in a collapsed condition, comprising the steps of moving a pair of mating locking members into interlocking relationship automatically in response to collapsing of the road marker and releasably holding the mating locking members in interlocking relationship by the force from a resilient member.

Improved locking is also achieved by provision of a method of locking a collapsible road marker in a collapsed condition, comprising the steps of moving a pair of misaligned mating locking members toward each other during collapsing of the road marker and then automatically guiding the members into alignment to enable a releasible interlocking relationship between the interlocking members when in proximity with each other.

Improved visibility is achieved by providing a method of mounting a reflector to a collapsible hollow road marker with an exterior wall, comprising the steps of forming the reflector with an elongate flexible body and weaving the reflector body in and out of passageways through the exterior wall of the marker.

DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which.

DESCRIPTION OF THE PREFERRED EMBODIMENT

Figure 1:
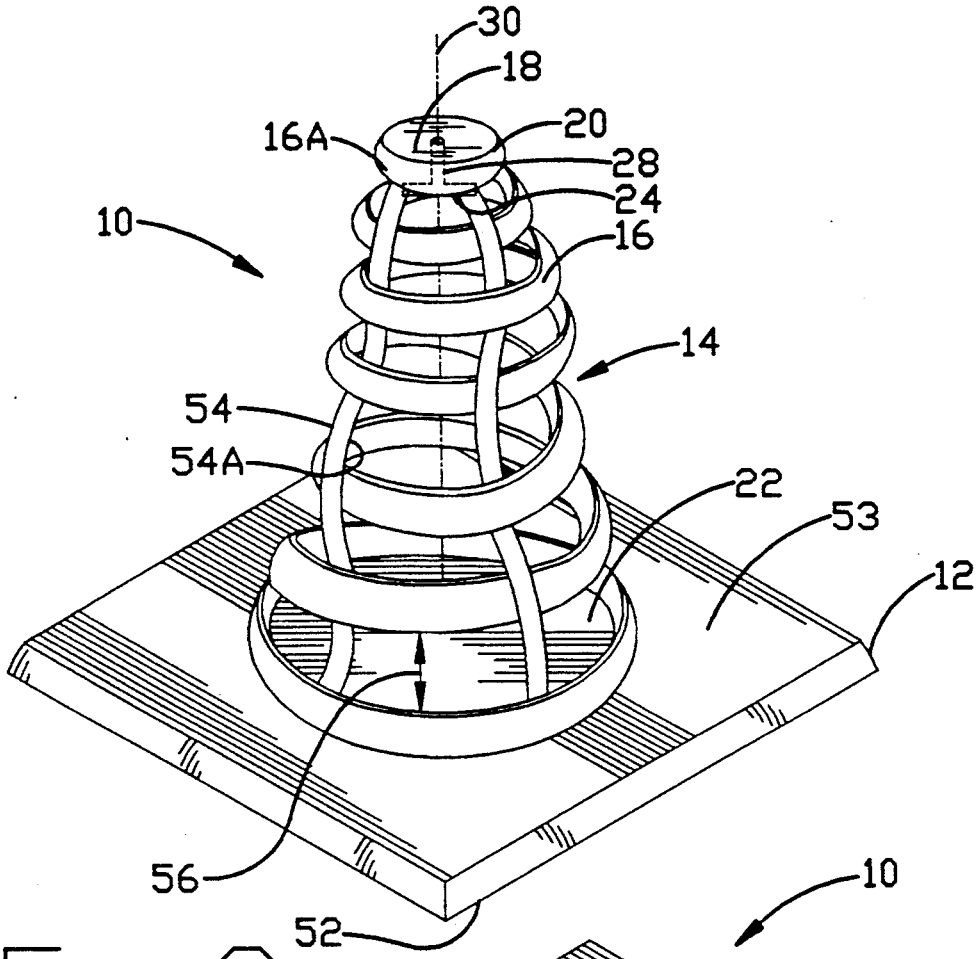
FIG. 1 is a perspective view of the preferred embodiment of the collapsible road marker of the present invention when in its operative erect condition.
Figure 2:
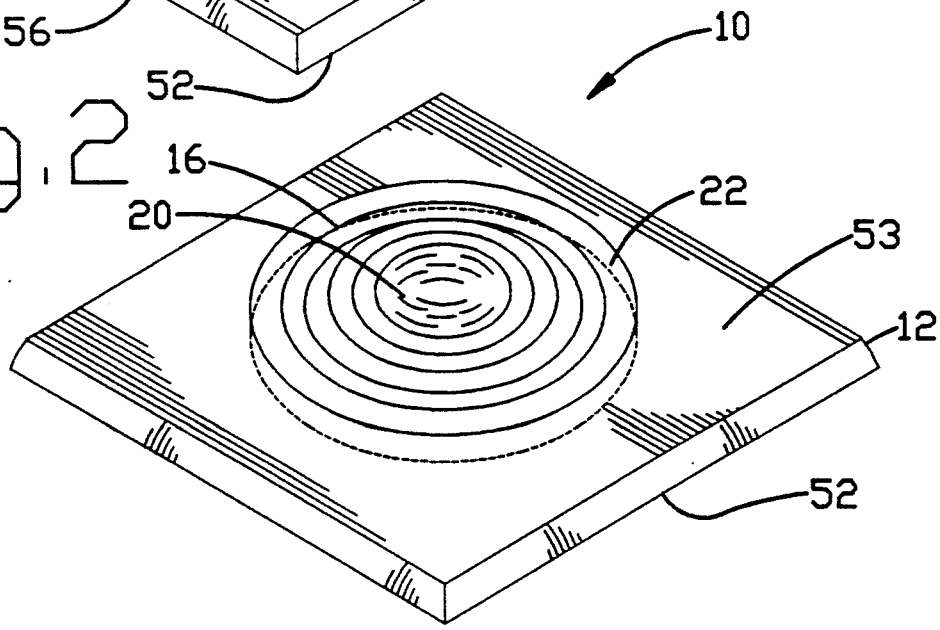
FIG. 2 is another perspective view of reduced size of the collapsible road marker of FIG. 1 when in an inoperative collapsed condition for storage or transport.

Referring now to FIGS. 1 and 2 of the drawing, the preferred embodiment of the automatic locking, collapsible road marker 10 of the present invention seen in the noncollapsed, erect, operative condition for use and in the collapsed condition for transport and storage, respectively. As best seen in FIG. 1, the road marker 10 has a wide rectangular base 12 which is preferably made of a molded piece of durable, impact resistant plastic or hardened rubber-like compound to which is mounted a conical, collapsible body 14 preferably made of spring steel, resilient plastic or other resilient material which has been formed into a spiral arm 16 in the erect position shown in FIG. 1, when unstressed.

When a cap 18 at the apex 20 of the collapsible body 14 is forced downwardly into a recess 22 in the base 12 the collapsible body is distorted into a planar coil. Once in the flat, collapsed coil configuration within the recess of the base 22 shown in FIG. 2, the resiliency of the spiral arm 16 will cause the spiral arm 16 to return to the erect position shown in FIG. 1 unless restrained from doing so. In the aforementioned patent of Campbell, this is accomplished by means of a locking mechanism employing an elongate opening which must be passed over a wing nut. The wing nut must be first manually aligned to pass through the slot and then the wing nut must be manually moved crosswise to the elongate direction of the opening to block the coiled arm from resiliently pulling it back through the slot. In achieving at least some of the objectives of the invention, some or all of these awkward, time consuming steps are eliminated by causing them to be automatically performed in response to the mere action of collapsing the collapsible body.

Figure 3:
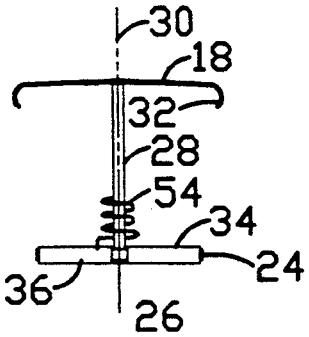
FIG. 3 is an enlarged side view of a preferred form of a handle and latch member assembly forming part of the collapsible road marker of FIGS. 1 and 2.

Referring to FIG. 3, an elongate latch member 24 is mounted at the end 26 of an elongate axial post 28, the other end of which is attached to the underside of cap 18, also seen in FIG. 1. The axial post 28 extends along a center axis of symmetry 30 of the conical, collapsible body while the latch member 24 extends in a direction substantially transverse to the axis 30. The cap 18 is circular and has an inwardly curved flange 32 at its circumference which is crimped over the top spiral arm segment 16A, welded or otherwise fastened to the top arm segment 16A, as shown in FIG. 1.

Figure 4:
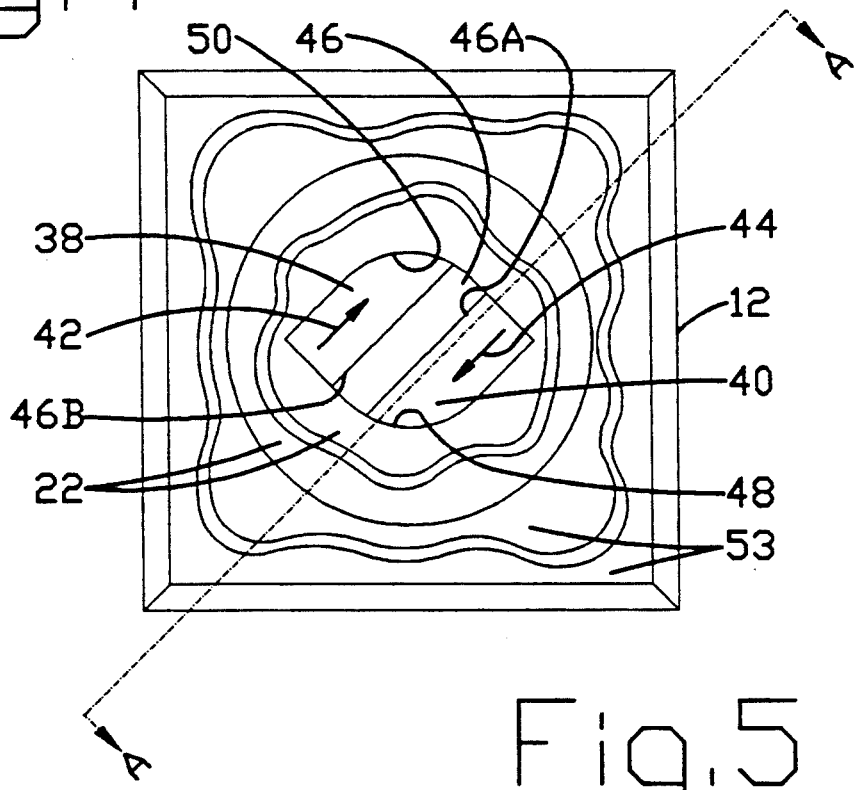
FIG. 4 is an enlarged plan view of the base, cam guide surfaces and latch member engaging slot of the collapsible road marker of FIGS. 1 and 2.
Figure 5:
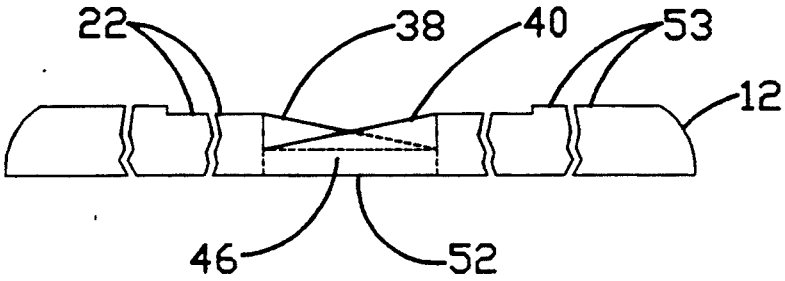
FIG. 5 is a cross-sectional view along line A—A of FIG. 4.

A pair of cylindrical rollers 34 and 36, preferably made of nylon or other like material are rotatably mounted to opposite ends of the latch member 24, respectively, to reduce friction between the latch member 24 and another member associated with the base. Referring to FIG. 4A, the other member upon which the latch member rolls on its rollers 34 and 36 has cam guide surfaces 38 and 40. These are respectively beveled downwardly into the base 12 and in the direction of arrows 42 and 44 to a level beneath the top surface 53 of the base by a distance of approximately one-half inch. At this lower level is the opening of a slot 46. When the rollers 34 and 36 are pushed downwardly onto the beveled cam surfaces 38 and 40, they will begin to roll down the cam guide surfaces while being forced to rotate by cam guide curved walls 48 and 50 as they roll down the incline until the latch member 24 is aligned with, and thereby enabled to operatively engage with, the slot 46.

In a preferred form of the locking mechanism, the lock member 24 is mounted for rotation about the axle post 28 and thus will freely rotate into alignment with the slot 46 without rotating or otherwise distorting the spiral arm 14 of the collapsible body 14. In such case, the slot 46 is an opening through which the latch member is passed and then manually turned on the other side of the base to be aligned crosswise to the elongate direction of the slot 46. The bottom 52 of the base 12 then engages the latch member while the resilient force of the spiral arm 16 pulling away from the base 12 holds the latch member 24 and a portion of the bottom 52 adjacent slot 46 in interlocked relationship.

Alternately, to eliminate the step of manually turning the latch member 24 crosswise after it has passed through the slot 46, a coil spring 55 is provided to spring bias the latch member to a position misaligned with the slot 46. The cam guide surfaces and curved walls 38, 40, 48 and 50 cause the latch member to rotate in opposition to the force of the coil spring 54 until it is aligned with the slot 46 and can enter and pass through the slot. Once it passes through the slot, the coil spring then causes it to automatically rotate to a crosswise locking position.

In lieu of the coil spring 55, the natural coil spring action of the spiral arm 16 is employed to rotate the axial post 28 to align the latch member 24 with the latch engaging slot 46. In such case, the latch member is fixedly mounted to the end of the axial post 28 and the latch member is misaligned with the slot 46. Thus, when the latch member 24 is caused to rotate by the cam guide surfaces and curved walls when pushed down, it will distort the spiral arm 16 by twisting it about the center axis 30. When the latch member 24 passes through the slot 46, the resiliency of the spiral arm 16 will cause it to return to its nondistorted shape with the latch member crosswise to the slot 46.

Both the preferred and alternate approaches require the latch member 24 to be manually moved back to alignment with the slot 46 in order to unlock the collapsible body from the base 12. In another form of the lock mechanism, the latch member 24 does not pass through the slot but instead is held in the slot by lateral frictional forces generated by either the spiral arm 16 or a separate coil spring 55 pressing the latch member 24 against the side walls 46A and 46B of the slot. In such case, the slot side walls 46A and 46B are corrugated or otherwise treated to enhance their frictional holding ability and a low friction surface is used on the cam guide surfaces 38, 40 in lieu of using rollers 34 and 36.

Referring now to FIG. 1, the objective of increasing visibility by the easy mounting of additional reflective members is achieved by providing a plurality of elongate reflective members 54 which are woven in and out of laterally spaced segments of spiral arm 16 for easy mounting. Preferably, the top end of the reflective member 54 is secured to the cap 18 by being crimped to the spiral arm 16A by means of flanges 32 or otherwise.

Achieving two other objects of the invention, the distance between the middle of the arms to the middle of laterally adjacent arms is greater than the thickness of the arms throughout the length of the collapsible body. Accordingly, there are substantial gaps 56 between the arm segments which define passageways straight through the collapsible body 14 from the apex 20 to the base 12 for improved stability in windy conditions.

The passageway also enable the inside surface of the reflector member 54 on one side of the body 14 to be seen on the other side of the body. Accordingly, in keeping with another aspect of the invention, reflective surfaces are provided on the inside of the reflective members, so they can reflect light on both sides. In addition to reducing the amount of reflective members required, the inwardly directed reflective surface 54A of the reflector member 54 create an appearance of depth to the marker which is more visually stimulating. In addition, because they are on the interior, the inwardly facing reflective surfaces are intermittently blocked from view to moving traffic by the spiral arms and reflective members in front of it to create a twinkling effect which also enhances visibility.

While a detailed description of the preferred embodiment of the invention has been given, it should be appreciated that many variations can be made thereto without departing from the scope of the invention as set forth in the appended claims.

I claim:

1. In a collapsible road marker having a base, a collapsible body with a fixed end mounted adjacent to the base and a distal end mounted for movement between the base, whereat the distal end is located when the body is in a collapsed position, and an erect position spaced from the base when the body is in an erect position, the improvement being an automatic locking assembly for releasably holding the movably mounted distal end of the collapsible body adjacent to the base, comprising:

a latch member mounted to the one of the collapsible body and the base for movement between a locked position and a nonlocked position;

a latch engaging member mounted to the other of the collapsible body and the base to interlock with the latch member when in a locked position; and means for automatically moving the latch member at least partially to the locked position to interlock with the latch engaging member in response to relative movement of the latch member and the latch engaging member toward each other and into adjacent interrelationship, including means for spring biasing the latch member toward the unlocked position, said spring biasing means being a coil spring for rotating the latch member from the locked position to the unlocked position.

2. The collapsible road marker of claim 1 in which the latch member is an elongate latch member, and the latch engaging member has a elongate slot sized to accept the elongate latch member.

3. The collapsible road marker of claim 2 including means for moving the elongate latch member through the latch engaging member when the elongate latch member is aligned with the slot.

4. The collapsible road marker of claim 3 including means for releasably maintaining the latch member in the locked position when the elongate latch member is misaligned with the slot.

5. The collapsible road marker of claim 1 in which said latch member automatically moving means includes means for providing said latch member with means for reducing friction during relative movement between the latch member and another member.

6. In a collapsible road marker having a base, a collapsible body with a fixed end mounted adjacent to the base and a distal end mounted for movement between the base, whereat the distal end is located when the body is in a collapsed position, and an erect position spaced from the base when the body is in an erect position, the improvement being an automatic locking assembly for releasably holding the movably mounted distal end of the collapsible body adjacent to the base, comprising:

a latch member mounted to the one of the collapsible body and the base for movement between a locked position and a nonlocked position;

a latch engaging member mounted to the other of the collapsible body and the base to interlock with the latch member when in a locked position; and means for automatically moving the latch member at least partially to the locked position to interlock with the latch engaging member in response to relative movement of the latch member and the latch engaging member toward each other and into adjacent interrelationship, including means for spring biasing the latch member toward the unlocked position and a cam guide surface for guiding the latch member to a locked position.

7. In a collapsible road marker having a base, a collapsible body with a fixed end mounted adjacent to the base and a distal end mounted for movement between the base, whereat the distal end is located when the body is in a collapsed position, and an erect position spaced from the base when the body is in an erect position, the improvement being an automatic locking assembly for releasably holding the movably mounted distal end of the collapsible body adjacent to the base, comprising:

a latch member mounted to the one of the collapsible body and the base for movement between a locked position and a nonlocked position;

a latch engaging member mounted to the other of the collapsible body and the base to interlock with the latch member when in a locked position; and means for automatically moving the latch member at least partially to the locked position to interlock with the latch engaging member in response to relative movement of the latch member and the latch engaging member toward each other and into adjacent interrelationship, including means for spring biasing the latch member toward the unlocked position and means for automatically causing the latch member to rotate from the unlocked position to the locked position in response to movement of the distal end toward the base.

8. In a collapsible road marker having a base, a collapsible body with a fixed end mounted adjacent to the base and a distal end mounted for movement between the base, whereat the distal end is located when the body is in a collapsed position, and an erect position spaced from the base when the body is in an erect position, the improvement being an automatic locking assembly for releasably holding the movably mounted distal end of the collapsible body adjacent to the base, comprising:

a latch member mounted to the one of the collapsible body and the base for movement between a locked position and a nonlocked position;

a latch engaging member mounted to the other of the collapsible body and the base to interlock with the latch member when in a locked position; and means for automatically moving the latch member at least partially to the locked position to interlock with the latch engaging member in response to relative movement of the latch member and the latch engaging member toward each other and into adjacent interrelationship, including means for spring biasing the latch member toward the unlocked position, said spring biasing means being formed by a spiral arm of the collapsible body.

9. The collapsible road marker of claim 8 in which said latch engaging member has a slot within which the latch member is held when it is in the locked position.

10. A collapsible road marker, comprising:

a resilient spiral arm defining a collapsible body having a generally conical shape having an apex and with a central axis of symmetry passing through the apex;

a latch member mounted to the collapsible body at the apex;

a base member with a slot for receiving the latch member to block the latch member and the apex against movement about said central axis, said slot frictionally holding the latch member against removal from blocking engaging within the slot by opposing forces of the resilient spiral arm; and a pair of opposed cam guides for engagement with the opposite ends of the latch member to guide them in opposite directions.

11. In a collapsible road marker having a base, a collapsible body with a fixed end mounted adjacent to the base and a distal end mounted for movement between the base, whereat the distal end is located when the body is in a collapsed position, and an erect position spaced from the base when the body is in an erect position, the improvement being an automatic locking assembly for releasably holding the movably mounted distal end of the collapsible body adjacent to the base, comprising:

a latch member carried by the collapsible body adjacent the distal end for movement between a locked position and a nonlocked position;

a latch engaging member mounted to the base to interlock with the latch member when in a locked position, the latch engaging member having an elongate slot for mating receipt therein of the latch member; and means for automatically moving the latch member at least partially to the locked position to interlock with the latch engaging member in response to relative movement of the latch member and the latch engaging member toward each other and into adjacent interrelationship.

12. In a collapsible road marker having a base, a collapsible body with a fixed end mounted adjacent to the base and a distal end mounted for movement between the base, whereat the distal end is located when the body is in a collapsed position, and an erect position spaced from the base when the body is in an erect position, the improvement being an automatic locking assembly for releasably holding the movably mounted distal end of the collapsible body adjacent to the base, comprising:

a latch member mounted to the one of the collapsible body and the base for movement between a locked position and a nonlocked position;

a latch engaging member mounted to the other of the collapsible body and the base to interlock with the latch member when in a locked position;

means for automatically moving the latch member at least partially to the locked position to interlock with the latch engaging member in response to relative movement of the latch member and the latch engaging member toward each other and into adjacent interrelationship;

means for mounting the latch member for rotation between the locked and nonlocked positions; and in which said automatically moving means includes means for rotating the latch member into the locked position in response to relative rectilinear movement between the latch member and the latch engaging member.

13. In a collapsible road marker having a base, a collapsible body with a fixed end mounted adjacent to the base and a distal end mounted for movement between the base, whereat the distal end is located when the body is in a collapsed position, and an erect position spaced from the base when the body is in an erect position, the improvement being an automatic locking assembly for releasably holding the movably mounted distal end of the collapsible body adjacent to the base, comprising:

a latch member mounted to the one of the collapsible body and the base for movement between a locked position and a nonlocked position;

a latch engaging member mounted to the other of the collapsible body and the base to interlock with the latch member when in a locked position; and means for automatically moving the latch member at least partially to the locked position to interlock with the latch engaging member in response to relative movement of the latch member and the latch engaging member toward each other and into adjacent interrelationship, including a cam guide surface engageable by the latch member to guide the latch member to the locked position in interlocking relationship with the latch engaging member.

14. In a collapsible road marker having a base, a collapsible body with a fixed end mounted adjacent to the base and a distal end mounted for movement between the base, whereat the distal end is located when the body is in a collapsed position, and an erect position spaced from the base when the body is in an erect position, the improvement being an automatic locking assembly for releasably holding the movably mounted distal end of the collapsible body adjacent to the base, comprising:

a latch member mounted to the one of the collapsible body and the base for movement between a locked position and a nonlocked position and having a pair of opposed ends;

a latch engaging member mounted to the other of the collapsible body and the base to interlock with the latch member when in a locked position; and means for automatically moving the latch member at least partially to the locked position to interlock with the latch engaging member in response to relative movement of the latch member and the latch engaging member toward each other and into adjacent interrelationship, including means for mounting the latch member to rotate about an axis intermediate the opposed ends, and a pair of opposed cam guide surfaces for respectively guiding the pair of opposed ends in substantially opposite directions to rotate the latch member about said axis.

15. A collapsible road marker, comprising:

a resilient spiral arm defining a collapsible body having a generally conical shape having an apex and with a central axis of symmetry passing through the apex;

a latch member mounted to the collapsible body at the apex; and a base member with a slot for receiving the latch member to block the latch member and the apex against movement about said central axis, said slot frictionally holding the latch member against removal from blocking engagement within the slot by opposing forces of the resilient spiral arm, said latch member being mounted to the apex by means of a post extending along the central axis and has one end attached to the collapsible body at the apex and a distal end spaced from the apex to which the elongate latch member is rotatably attached.

16. In a collapsible road marker having a base, a collapsible body with a fixed end mounted adjacent to the base and a distal end mounted for movement between the base, whereat the distal end is located when the body is in a collapsed position, and an erect position spaced from the base when the body is in an erect, the improvement being an automatic locking assembly for releasably holding the movably mounted distal end of the collapsible body adjacent to the base, comprising:

a latch member mounted to the one of the collapsible body and the base for movement between a locked position and a nonlocked position;

a latch engaging member mounted to the other of the collapsible body and the base to interlock with the latch member when in a locked position; and means for automatically moving the latch member at least partially to the locked position to interlock with the latch engaging member in response to relative movement of the latch member and the latch engaging member toward each other and into adjacent interrelationship, including means for providing said latch member with means for reducing friction during relative movement between the latch member and a cam guide surface engageable by the latch member to guide it to the locked position in engagement with the latch engaging member.

17. In a collapsible road marker having a base, a collapsible body with a fixed end mounted adjacent to the base and a distal end mounted for movement between the base, whereat the distal end is located when the body is in a collapsed position, and an erect position spaced from the base when the body is in an erect position, the improvement being an automatic locking assembly for releasably holding the movably mounted distal end of the collapsible body adjacent to the base, comprising:

a latch member mounted to the one of the collapsible body and the base for movement between a locked position and a nonlocked position including a cylindrical roller with a center axis and means for mounted the roller for rotation about said center axis;

a latch engaging member mounted to the other of the collapsible body and the base to interlock with the latch member when in a locked position; and means for automatically moving the latch member at least partially to the locked position to interlock with the latch engaging member in response to relative movement of the latch member and the latch engaging member toward each other and into adjacent interrelationship, including means for providing said latch member with means for reducing friction during relative movement between the latch member and a cam guide surface engageable by the latch member to guide it to the locked position in engagement with the latch engaging member.

18. In a collapsible road marker having a base, a collapsible body with a fixed end mounted adjacent to the base and a distal end mounted for movement between the base, whereat the distal end is located when the body is in a collapsed position, and an erect position spaced from the base when the body is in an erect, the improvement being an automatic locking assembly for releasably holding the movably mounted distal end of the collapsible body adjacent to the base, comprising:

a latch member mounted to the one of the collapsible body and the base for movement between a locked position and a nonlocked position;

a latch engaging member including a slot within which is received the latch member mounted to the other of the collapsible body and the base to interlock with the latch member when in a locked position; and means for automatically moving the latch member at least partially to the locked position to interlock with the latch engaging member in response to relative movement of the latch member and the latch engaging member toward each other and into adjacent interrelationship.

19. In a collapsible road marker having a base, a collapsible body with a fixed end mounted adjacent to the base and a distal end mounted for movement between the base, whereat the distal end is located when the body is in a collapsed position, and an erect position spaced from the base when the body is in an erect position, the improvement being an automatic locking assembly for releasably holding the movably mounted distal end of the collapsible body adjacent to the base, comprising:

a latch member mounted to the one of the collapsible body and the base for movement between a locked position and a nonlocked position, said latch member is an elongate member mounted for rotation relative to the collapsible body;

a latch engaging member mounted to the other of the collapsible body and the base to interlock with the latch member when in a locked position, said latch engaging member including a portion of the base with a slot for receipt therethrough of the latch member; and means for automatically moving the latch member at least partially to the locked position to interlock with the latch engaging member in response to relative movement of the latch member and the latch engaging member toward each other and into adjacent interrelationship, including a cam guide surface to guide the latch member into alignment with the slot to facilitate its passage therethrough.

20. A collapsible road marker, comprising:

a resilient spiral arm defining a collapsible body having a generally conical shape having an apex and with a central axis of symmetry passing through the apex;

a latch member mounted to the collapsible body at the apex; and a base member with a slot for receiving the latch member to block the latch member and the apex against movement about said central axis, said slot frictionally holding the latch member against removal from blocking engagement within the slot by opposing forces of the resilient spiral arm.

21. A collapsible road marker, comprising:

a resilient spiral arm defining a collapsible body having a generally conical shape with an apex and a central axis of symmetry passing through the apex;

a latch member mounted to the collapsible body at the apex; and a base member with a slot for receiving the latch member to block the latch member and the apex against movement about said central axis, said slot frictionally holding the latch member against removal from blocking engagement within the slot by opposing forces of the resilient spiral arm, and a cam guide surface assembly to rotate the latch member into alignment with the slot when the collapsible body is collapsed.

22. A method of locking a collapsible road marker in a collapsed condition, comprising the steps of:

moving a pair of misaligned mating locking members toward each other during collapsing of the road marker; and automatically guiding the mating locking members into alignment to enable a releasible interlocking relationship between the interlocking members including the steps of pressing one of the pair of locking members into a cam guide surface, and guiding the one locking member along a path established by the cam guide surface to the other one of the pair of interlocking members.

23. A method of locking a collapsible road marker in a collapsed condition, comprising the steps of:

moving an elongate locking member through an elongate opening in a mating locking member;

rotating the elongate locking member into a position misaligned with the longitudinally shaped opening; and releasably holding the elongate locking member and the mating locking member in interlocking relationship.

24. The method of claim 23 in which the step of releasably holding includes the step of directing a force generated by the resiliency of the collapsible body to hold the mating locking member and elongate member in interlocking relationship.

25. The method of claim 23 in which the resiliency generated force is generated by distorting a spiral arm of the collapsible body.

* * * * *

UNITED STATES PATENT AND TRADEMARK OFFICE

CERTIFICATE OF CORRECTION

PATENT NO. : 5,305,705

DATED : April 26, 1994

INVENTOR(S) : Greg R. Gagliano

It is certified that error appears in the above-identified patent and that said Letters Patent is hereby corrected as shown below:

Col. 4, line 55, change "4A" to - 4 -; and
Col. 4, line 57, after "40" delete the period and insert --, respectively.--.

Signed and Sealed this

Sixth Day of September, 1994

*Attest:*

Bruce Lehman

BRUCE LEHMAN

*Attesting Officer*

*Commissioner of Patents and Trademarks*